United States Patent [19]

Acevedo

[11] 4,371,170

[45] Feb. 1, 1983

[54] ALIGNMENT GAME WITH CROSS SHAPED PLAYING FIELD

[75] Inventor: Francisco Acevedo, Caguas, P.R.

[73] Assignee: Commonwealth of Puerto Rico, San Juan, P.R.

[21] Appl. No.: 247,107

[22] Filed: Mar. 24, 1981

[51] Int. Cl.[3] ..... A63F 3/00

[52] U.S. Cl. ..... 273/271

[58] Field of Search ..... 273/264, 271

[56] References Cited

U.S. PATENT DOCUMENTS 1,714,792 5/1929 Kurihara ..... 273/271

3,111,320 11/1963 Acosta ..... 273/271

*Primary Examiner*—Anton O. Oechsle

*Attorney, Agent, or Firm*—Scrivener, Clarke, Scrivener and Johnson

[57] ABSTRACT

The disclosure is of a game comprising a board having a cross shaped playing field marked thereon which is formed by squares defined by intersecting lines, two sets of differently marked movable game pieces, and two dice. The game is played by moving the game pieces to points of intersection of the lines, and using the dice, in accordance with rules of the game.

1 Claim, 4 Drawing Figures

ALIGNMENT GAME WITH CROSS SHAPED PLAYING FIELD

SUMMARY OF THE INVENTION

The component parts of the game are a cross shaped playing field divided by intersecting north and south lines into twenty-one equal squares with thirty-two points of intersection, two sets of differently colored play pieces, and dice. The pieces are moved to points of intersection and the play is scored in accordance with rules of the game.

DESCRIPTION OF THE INVENTION

The parts of the game provided by the invention comprise a game board having a playing field marked thereon, two sets of differently marked movable game pieces, and two dice.

Figure 1:
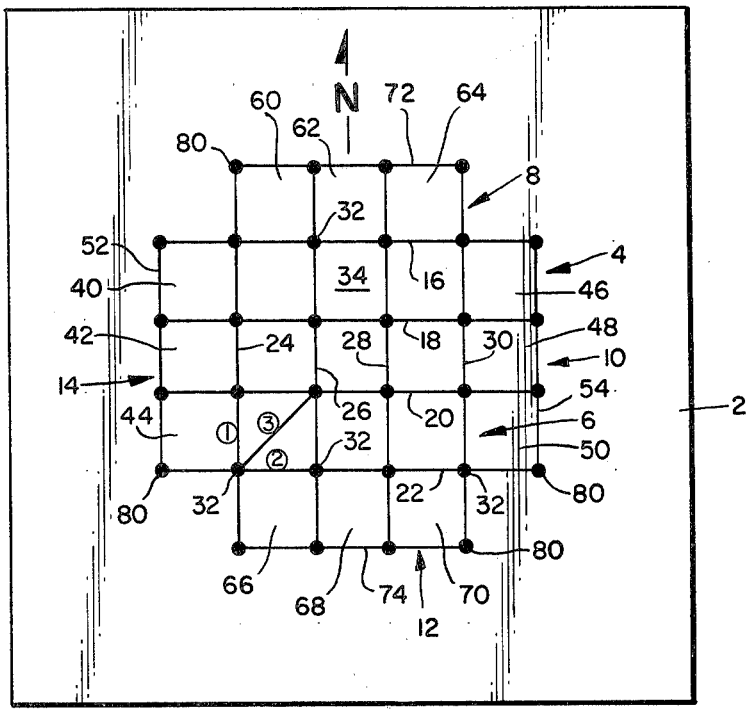
FIG. 1 is an elevational view of the game board and the playing field thereon provided by the invention.

The game board 2 is shown in FIG. 1 and is preferably a piece of rigid material in the center of which there is marked in any suitable manner a playing field 4 having a square central area 6 and four rectangular outer areas 8, 10, 12, 14 which together form a cross. The central area is defined by four equally spaced east-west lines 16, 18, 20, 22 and four equally spaced north-south lines 24, 26, 28, 30 which intersect in sixteen points 32 to form nine equal squares 34.

The two side areas 10, 14 are formed by extending each of the east-west lines beyond the east-west boundary lines 24, 30 of the central area to form three squares 40, 42, 44 of equal size at the west side of the central area and three squares 46, 48, 50 of equal size at the east side of the central area, the west squares being bounded on the outside by line 52 and those on the east side by line 54. The two upper and lower areas 8, 12 of the cross shaped playing field are formed by extending each of the north-south extending lines, 24, 26, 28, 30 beyond the north and south boundary lines 16, 22 of the central area to form three squares 60, 62, 64 of equal size at the north side of the central area and three squares 66, 68, 70 of equal size at the south side of the central area, the north squares being bounded on the outside by line 72 and those on the south side by line 74.

All of the squares of the entire cross shaped playing field are of the same size, and all points of intersection of the lines defining the squares of the playing field are marked or otherwise identified, as by colored circles.

Figure 2:
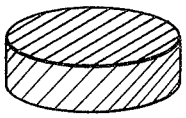
FIGS. 2 and 3 show representative game pieces of the two sets of pieces provided by the invention.
Figure 3:
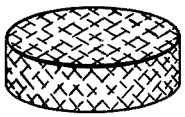

In addition to the described playing field the game parts include two sets of movable game pieces such as those used in the game of checkers, those of one set being distinguished from those of the other set in some way such as by being differently colored. Representative game pieces are shown in FIGS. 2 and 3 of the drawings, and in the preferred embodiment of the invention, which is particularly useful with the playing field shown in FIG. 1, each set of game pieces will comprise twenty-four pieces.

Figure 4:
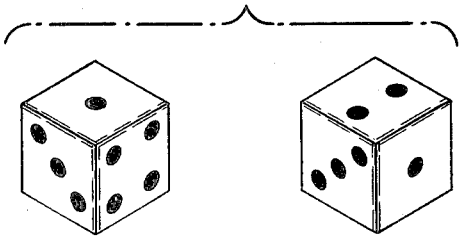
FIG. 4 shows the dice which are used in playing the game.

The apparatus needed to play the game is completed by the provision of two conventional dice such as those shown in FIG. 4.

The game is designed to be played by two players and is begun by each player throwing one of the dice. The player throwing the higher number begins the game by placing one of his game pieces on any intersection point 32 of the central area of the playing field. The other player now places one of his pieces on another intersection point of the central area, and the players then alternately place their pieces on intersection points of the central area until all of its sixteen intersection points are filled. To fill the remaining sixteen points of the east-west and north-south side areas 8, 10, 12, 14 the players alternately, throw the dice and the player throwing the higher number on each throw places one of his pieces on one of the four outer intersection points 80 of the north-south and east-west outer areas of the cross-shaped figure until all of these sixteen points have been filled.

Each player scores three points for pieces occupying diagonally related ajacent points 32, two points for pieces occupying horizontally related adjacent points, and one point for pieces occupying vertically related adjacent points, as indicated in FIG. 1, and the winner is the one with the highest score.

I claim:

1. A game to be played by two or four players in accordance with rules, comprising the following parts, (a) a game board having marked thereon a cross shaped playing field consisting in its entirety of i. a square central area subdivided into nine squares of equal size by four north-south extending lines and four east-west extending lines providing sixteen points of intersection, ii. each of the north-south lines being extended beyond the central area to provide both north and south of the central area three squares which are equal in size to the squares of the central area bounded at the north or south extremity by east-west extending lines defining four points of intersection with the north-south extending lines, iii. each of the east-west lines being extended beyond the central area to provide both east and west of the central area three squares which are equal in size to the squares of the central area bounded at the east or west extremity by north-south extending lines defining four points of intersection with the east-west extending lines, (b) two sets of visually differentiated movable play pieces, (c) at least one die, and (d) a set of rules by which the play pieces are moved to points of intersection.

* * * * *